United States Patent [19]

Scaran

[11] 4,274,393

[45] Jun. 23, 1981

[54] FIREPLACE ASSEMBLY

[75] Inventor: Robert T. Scaran, Newark, Del.

[73] Assignee: R. Scaran, Inc., Newark, Del.

[21] Appl. No.: 59,395

[22] Filed: Jul. 20, 1979

[51] Int. Cl.[3] ..... F24C 15/30

[52] U.S. Cl. ..... 126/123; 126/134; 126/60; 126/83; 126/279

[58] Field of Search ..... 126/134, 279, 58, 60, 126/61, 62, 63, 64, 65, 66, 67, 77, 83, 290, 123

[56] References Cited

U.S. PATENT DOCUMENTS

| | | | |
|---|---|---|---|
| 210,870 | 12/1878 | Morgan | 126/123 |
| 1,728,241 | 9/1929 | Klemme | 126/58 |
| 2,064,064 | 12/1936 | Hanker | 126/290 |
| 2,183,458 | 12/1939 | Lathrop | 126/134 |
| 2,199,875 | 5/1940 | Brogden | 126/290 |
| 4,036,205 | 7/1977 | Hayes | 126/126 |
| 4,127,100 | 11/1978 | Baker | 126/66 |
| 4,136,665 | 1/1979 | Steffen | 126/123 |
| 4,157,704 | 6/1979 | Zimmer | 126/62 |
| 4,182,302 | 1/1980 | Bruce et al. | 126/83 |
| 4,186,718 | 2/1980 | Goodwin | 126/61 |

FOREIGN PATENT DOCUMENTS

| | | | |
|---|---|---|---|
| 34249 | 12/1934 | Netherlands | 126/58 |

*Primary Examiner*—Samuel Scott
*Assistant Examiner*—Lee R. Barrett
*Attorney, Agent, or Firm*—Mortenson & Uebler

[57] ABSTRACT

A new fireplace assembly is provided which is inserted into a conventional fireplace and which is capable of greatly increasing the burning efficiency and heat output over conventional units, decreasing the waste heat lost and at the same time providing a unit which is as pleasing from an aesthetic standpoint as a conventional fireplace. The assembly of this invention includes a firebox in which combustion is maintained and mounted on the hearth of a fireplace, the firebox having doors in the front thereof opening into the combustion chamber, the doors having adjustable draft means therein to control the amount of air introduced to support combustion, a smoke outlet box mounted on the rear of the firebox and extending into the fireplace opening, the firebox having controllable damper means for conveying smoke from combustion to and up the chimney of the fireplace. The opening into the smoke outlet box is at least partially covered by a spark shield. A smoke shelf is provided which protrudes from the front of the firebox substantially horizontally into the combustion chamber. The spark shield and smoke shelf cooperatively coact to provide enhanced heat circulaton. An optional water trough located at the top of the firebox is provided into which water can be placed to increase humidity in the surrounding air.

10 Claims, 9 Drawing Figures

Fig. 3.
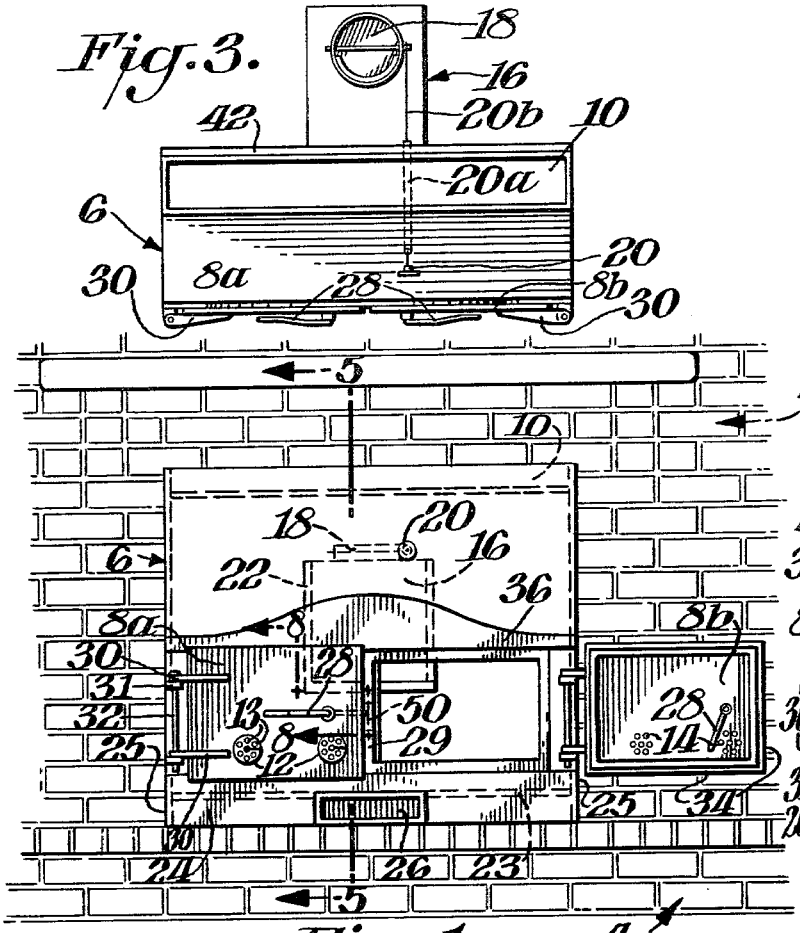
Fig. 1.
Fig. 2.
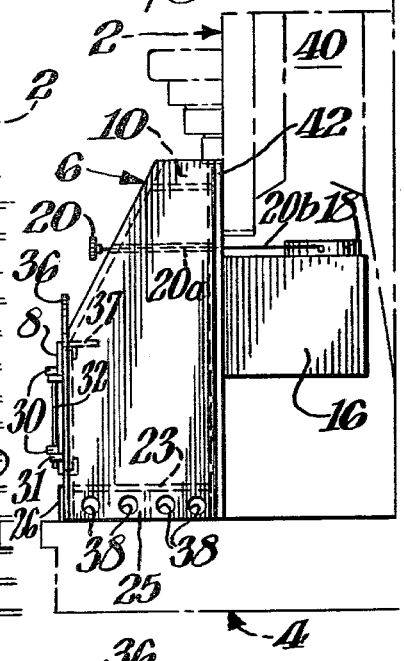
Fig. 4.
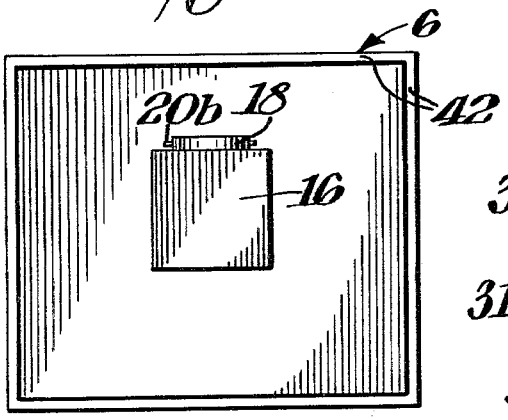
Fig. 8.
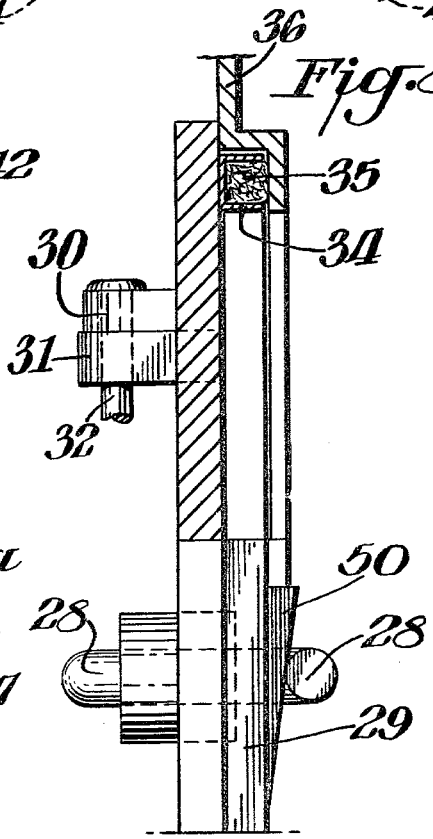
Fig. 6.
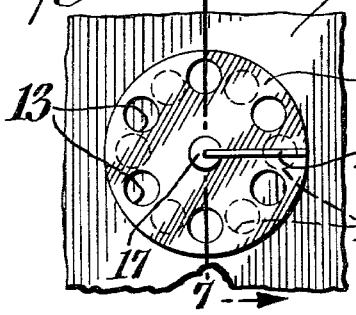
Fig. 7.
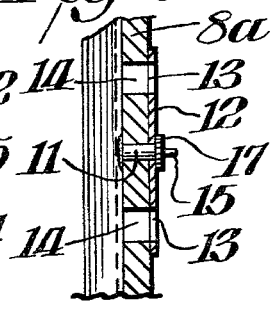

FIREPLACE ASSEMBLY

BACKGROUND OF THIS INVENTION

This invention relates to a new fireplace assembly which is inserted into a conventional fireplace in a home.

Conventional fireplaces can provide heat but their principal purpose in recent times has been to provide the aesthetically pleasing appearance of a burning wood fire on a cold evening. However, the conventional fireplace can actually waste an enormous amount of heat. While a fire is burning, a substantial fraction of the heat generated passes directly up the chimney and is wasted. When the fire is extinguished, and even when the damper is closed, the fireplace can drain considerable heat from the room, which heat is produced by other furnace means such as an oil burner. If the fireplace damper is left open, the fireplace becomes a virtual heat sink and can waste tremendous amounts of heat.

Considering the recent energy crisis and the accompanying skyrocketing prices of heating oil and other petroleum products, it is clear that there is a need for more efficient fireplace operation. The present invention provides a fireplace assembly which fulfills that need and which also provides the aesthetically pleasing appearance of a conventional fireplace if desired.

A variety of approaches have been tried in the past in attempts to improve the heat transfer characteristics and thus the efficiency of fireplaces. Among these approaches has been the use of auxiliary forced air circulating systems such as that disclosed in U.S. Pat. No. 4,129,114, for example. Others have attempted to combine fireplaces with existing forced air furnace systems. Such approaches have not been entirely satisfactory.

Other approaches at improving heat transfer characterisistics have included various fin-type assemblies which have been designed into fireplaces such as that shown in U.S. Pat. No. 4,026,263 or have been incorporated in furnace-type assemblies which are placed into otherwise conventional fireplaces such as that shown in U.S. Pat. No. 4,026,264.

Fireplace shields have been provided such as disclosed in U.S. Pat. No. 4,010,730, presumably to improve heat radiation from the fireplace and, in this connection, various assemblies employing glass doors placed so as to enclose the fire are well known as shown in U.S. Pat. Nos. 4,058,107 and 4,129,114.

The present invention concerns what may be classified as a furnace-type assembly which may be installed directly into an existing, otherwise conventional fireplace. Furnace type assemblies consisting of a cast iron firebox having a door for inserting combustible fuel into a combustion chamber and connections to expel smoke up the chimney, the entire assembly being installed in a fireplace, are known and are commercially available from, for example, Elliott Stove Sales, Lynch, Md. Such prior fireplace assemblies contain none of the key features of the present invention, which features are set forth in full detail hereinbelow.

SUMMARY OF THE INVENTION

A fireplace assembly is provided comprising a firebox installed upon the hearth of a fireplace in which to support combustion, the firebox having at least one door through which fuel may be introduced into the combustion zone, each such door having controllable draft means through which the flow of air to support combustion may be controlled, the firebox having at the top thereof a water trough into which water may be placed during combustion for the purpose of adding water vapor to the air around the fireplace assembly, and having a smoke outlet box mounted on the rear of the firebox extending into the fireplace opening, there being an opening in the rear wall of the firebox into the smoke outlet box through which the generated smoke passes into the smoke outlet box and thence through controllable damper means located on the smoke outlet box and opening into the chimney of the fireplace, the damper means controlling the amount of smoke and heat passing up said chimney, and having a spark shield located in the firebox and at least partially covering the opening into the smoke outlet chamber.

The fireplace assembly preferably is supported a distance above the hearth to provide a hollow space below the floor of the firebox.

Means for supporting the firebox above the hearth conveniently are downward extensions of the front and side walls of the firebox and have at least one vent opening in at least one of these walls into the hollow space to promote convection of air therethrough.

Preferred draft means, hinge means and door closure means are provided. The fireplace assembly of this invention preferably includes a spark shield extending from above the opening into the smoke outlet box in a direction forwardly and downwardly from the opening and substantially covering the opening but allowing for a gap between said shield and the opening.

This shield is preferably constructed in three sections, namely an upper section affixed at the top to the back wall of the firebox and slanting forwardly and downwardly from the top of the opening, a middle section affixed to the upper section and extending downwardly substantially parallel to the plane of the opening, and a lower section affixed to the second section and extending from the bottom of the second section downwardly and rearwardly leaving a gap between the lower edge of this lower section and the rear wall of the firebox.

BRIEF DESCRIPTION OF THE DRAWINGS

FIG. 1 is a front elevational view of the fireplace assembly of the present invention installed in a fireplace;

FIG. 2 is a side elevational view of the fireplace assembly with certain internal components not shown for clarity;

FIG. 3 is a top plan view of the fireplace assembly showing the firebox having water trough in the top thereof and smoke outlet box having damper controls extending to the front of the firebox, the fireplace being omitted for clarity;

FIG. 4 is a rear elevational view showing the firebox and smoke outlet box having adjustable damper means;

FIG. 6 is a front elevational view of a preferred controllable air draft means located in each door of the fireplace assembly;

FIG. 7 is a side elevational view of the preferred air draft means shown in FIG. 6; and FIG. 8 is a side elevational view, in part in cross-section, taken along the line 8—8 of FIG. 1, showing preferred closure means for the doors of the fireplace assembly of this invention and the U-channel door gasketing means.

Figure 5:
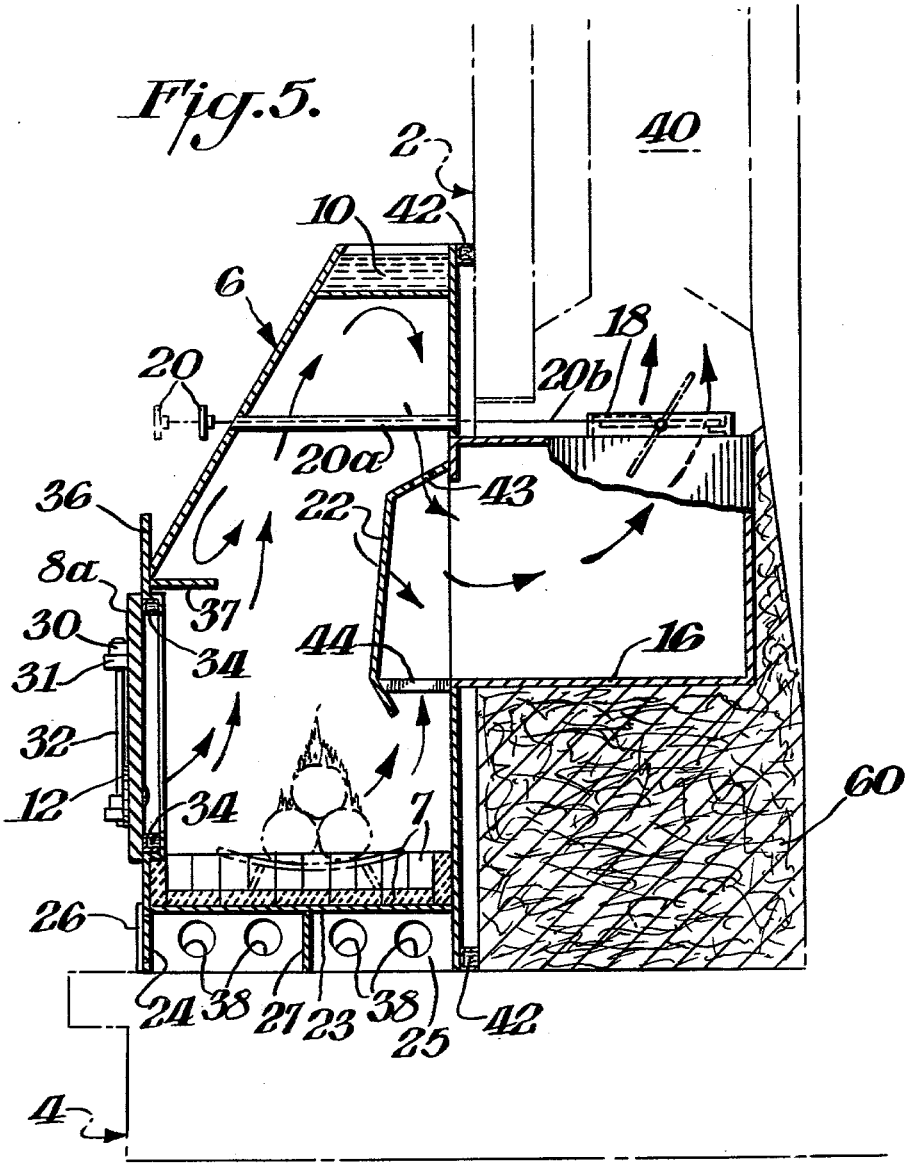
FIG. 5 is a side cross-sectional view of the fireplace assembly of this invention taken along line 5—5 of FIG. 1.

DETAILED DESCRIPTION OF THE INVENTION AND PREFERRED EMBODIMENTS WITH REFERENCE TO THE DRAWINGS

A new fireplace assembly is provided which is inserted into a conventional fireplace and which is capable of greatly increasing the burning efficiency and heat output over conventional units, decreasing the waste heat lost and at the same time providing a unit which is as pleasing from an aesthetic standpoint as a conventional fireplace. The assembly of this invention includes a firebox in which combustion is maintained mounted on the hearth of a fireplace, the firebox having doors in the front thereof opening to the combustion chamber, the firebox also having a water trough located at the top thereof into which water can be placed to increase humidity in the surrounding air thus making the heated air in the room heavier and heating the room air faster, draft means on the firebox doors to control the amount of air introduced therein to support combustion, a smoke outlet box mounted on the rear of the firebox and extending into the fireplace opening, the smoke outlet box having easily controllable damper means thereon and means for conveying smoke from the firebox combustion to and up the chimney of the fireplace, the opening into the smoke outlet box being at least partially covered by a spark shield. Optionally the bottom floor of the firebox, upon which combustion is maintained is supported a distance above the fireplace hearth leaving a hollow chamber thereunder formed by the hearth, the bottom of the firebox and the support walls, and openings in the side and front walls of this hollow chamber provide additional air convection below the combustion zone and into the surrounding air in the room, thereby further increasing the heating efficiency of this new assembly.

The most straightforward way to describe the invention in detail is by reference to the accompanying drawings.

FIG. 1 shows a front elevation of this invention. Therein is shown, in phantom, a conventional fireplace 2 having raised hearth 4. Hearth 4 need not be raised but can be flush to the floor. Located upon the hearth and in the fireplace is the assembly of this invention. The key elements of this assembly include a firebox 6 housing the combustion, a smoke outlet box 16 connected to the firebox and extending into the fireplace for conveying the smoke generated by combustion into and up the chimney, and a water trough 10 located in the top portion of the firebox into which water may be placed to produce added humidity in the room and to inhibit to an extent the buildup of creosote in the fireplace chimney. Optionally, the floor 23 of the firebox may be supported a distance above the surface of hearth 4, as shown, and have supporting side walls 25, front wall 24, and a center support, thereby providing a hollow space beneath the combustion zone. Vent duct 26 located in front wall 24 and openings in side walls 25, to be described in detail below, create additional convection currents and are employed to convey the heated air beneath the firebox floor 23 out into the room to provide additional heating.

Firebox 6 is preferably constructed of steel and preferably has two (2) doors 8*a* and 8*b* located on the front of the firebox through which combustible fuel may be placed into the combustion chamber and combustion products may be removed. Located on each door are draft means. Preferred draft means shown in FIG. 1 are discs 12 affixed to each door, two (2) such discs per door being preferred, each disc having a plurality of openings 13 therethrough. A plurality of openings 14 in each door are placed so as to align with openings 13 upon proper setting of disc 12. Openings 14 can be partially or completely closed off upon rotation of disc 12 resulting in control of draft to the combustion zone. In each disc as shown, six (6) openings of one-half inch diameter located equidistantly apart on a three (3) inch diameter circle and six (6) corresponding holes in each door for each disc are suitable.

FIG. 1 indicates door 8*a* to be closed and door 8*b* to be open. The preferred door hinge means shown comprise wedge shaped steel hinge brackets 30 welded to the door and rectangular steel brackets 31 welded to the front surface of the firebox and pin 31 extending through holes in hinge 30 and bracket 31 from the top hinge bracket downward through the bottom bracket. This assembly secures each door to the firebox and the pin can be removed providing for removal of each door for cleaning, painting, etc.

Door handle 28 is a "Z" shaped steel bar which is pulled upward to open the door as shown in connection with door 8*b* in FIG. 1. In the downward position, as with door 8*a*, the handle 28 secures the door in the closed position by snug engagement with wedge 50 located on center support 29.

The fireplace assembly of this invention can be utilized with the doors closed to provide a very highly efficient heating system. It can also be operated safely with both doors open if desired. Conventional fuels such as wood or coal can be burned in this fireplace assembly. No fuel or combustion is shown in FIG. 1 for clarity.

Panel 36 is decorative and, while preferred, it can be omitted without affecting operation of the assembly.

Smoke outlet box 16 having damper means 18 and damper control 20 and heat and spark shield 22 shown in FIG. 1 will be described in detail below.

FIG. 2 shows, in side elevation, fireplace 2 and hearth 4 into which is placed the firebox 6 and smoke outlet box 16. The smoke outlet box has adjustable damper means 18 controlled by means of knob 20 connected to arm 20*b* extending to the damper 18 through metal sleeve 20*a*. By pulling knob 20 out or pushing it in, the degree of opening of the damper may be controlled thereby controlling the amount of heat flow up the chimney 40.

The vent ports 38 opening into the hollow space below the combustion chamber are shown in FIG. 2. These vent ports effectively promote convection currents and the heat which is generated below the combustion zone and below the floor 23 of the firebox is circulated out of the hollow space and into the room in which the fireplace assembly is located. The cold air normally at low levels in a room is efficiently warmed.

The firebox 6 is sealed to the front wall of the fireplace by means of gasketing means 42. The gasket 42 is preferably a steel "U"-channel welded to the back periphery of the firebox and filled with fiberglass insulation, and the unit is fitted snugly to the fireplace wall, thereby effecting a seal.

FIG. 3 shows, in top plan, the firebox 6 having water trough 10 located in the top thereof and smoke outlet box 16 having damper means 18. This water trough preferably holds approximately one (1) gallon of water. When a fire is burning in the fireplace assembly, the water is heated to near boiling, about 210° F., and the water vapor formed humidifies the room and promotes still further convection of the air in the room. The humidified air provides for more comfortable breathing and less drying of furnishings and, in connection with the fireplace, inhibits buildup of creosote in the chimney of the fireplace. The creosote buildup during the first phase of combustion occurs under the bottom of the water trough in the firebox. As smoke is generated when a fire is ignited and the water in the trough is cool, creosote is deposited on the cool underside of the trough and buildup in the chimney is retarded until the water heats. Removal of the creosote from the bottom of the trough is relatively easy. The retarded buildup of creosote in the chimney is an added safety feature of this invention.

FIG. 4 is a rear elevation showing firebox 6 and smoke outlet box 16 having damper 18 and damper control rod **20*b*. The gasket means 42** is also shown.

FIG. 5, in cross section, shows the fireplace assembly of this invention in operation. Trough 10 is shown filled with water. A fire is shown burning in firebox 6 atop the firebrick 7 installed on the steel floor 23 of the firebox.

The doors are closed and draft means 12 are partially open to permit air to enter to support combustion. Damper means 18 are partially open to permit smoke to exhaust.

Figure 9:
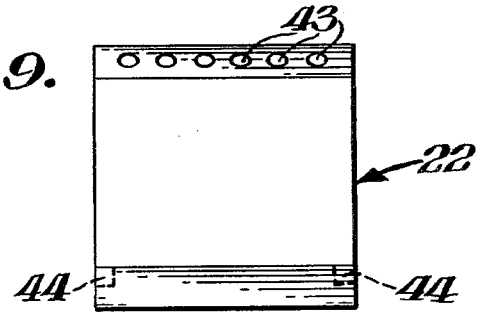
FIG. 9 is a front plan view of a preferred spark shield of this invention.

A key element in the fireplace assembly of this invention is the heat and spark shield 22 shown in FIG. 5. This shield extends from above the opening at the rear of the firebox into the smoke outlet box forwardly and downwardly from said opening and substantially covers said opening, allowing a gap between shield 22 and the smoke outlet box opening. This shield is preferably positioned about three (3) inches forward of the opening and is preferably constructed in three sections as shown, namely an upper section affixed (welded) at the top to the back wall of the firebox and slanting forward and downward from the top of said opening, a middle section substantially parallel to the plane of the opening to the smoke outlet box, and a third, lower section extending from the bottom of the second section downward and rearward leaving a gap between the lower edge of this lower section and the rear wall of the firebox. Preferably shield 22 has openings 43 in its upper section which can be holes of three-fourths inch diameter as shown in FIG. 9. Bracket supports 44 shown in FIGS. 5 and 9 may be used to secure the shield 22 to the rear wall of the firebox.

The metal spark and heat shield 22 inhibits sparks passing to the chimney and helps retain heat within the firebox by controlling the flow of heated air in a circular, downward motion and thence into the smoke outlet box.

Referring to FIG. 5, the arrows indicate the flow patterns inside the fireplace assembly of this invention. Air to support combustion enters through draft means 12. Heat and smoke rise from the fire and circulate in the upper portion of firebox 6 and then downward around smoke shelf 37 and into smoke outlet box 16 through openings 43 and under the spark and heat shield 22. The heat generated is effectively contained in the firebox and radiates to a great extent into the room. The heat generation and loss can be closely controlled by means of the draft and damper assemblies.

With the firebox doors closed, and when set for most efficient operation, combustion can be maintained for a long period of time. Also the fire need not be extinguished, for example upon retiring for the night, for safety reasons. Sparks cannot be ejected out into the room when the doors **8*a* and 8*b*** are closed.

Heat generated in the hollow space below the combustion area circulates into and through the room through side openings 38 and front vent 26, thereby greatly increasing the heat output and efficiency of this fireplace assembly over conventional systems.

The "U"-channel gasketing means 42, filled with fiberglas, are shown in FIG. 5 extending around the periphery of the firebox, as well as the similarly constructed door sealing gaskets 34. Fiberglas insulation 60 may be placed into the existing fireplace surrounding the smoke outlet chamber as shown, and this is preferred. This insulation effectively reduces heat losses out the back of the fireplace and into the fireplace foundation.

FIG. 6 is an enlarged detail view of the preferred draft means comprising large disc 12 having openings 13 therethrough and being affixed to the door **8*a* by means of a small disc 17 and a rod 11. Rod 11 is welded to disc 17 and passes through a hole in the center of disc 12 and thence into a hole in door 8*a*. The rod 11 is welded to door 8*a* from the inside, as shown in FIG. 7 which is a side cross-sectional view taken substantially along line 7—7 of FIG. 6. Handle 15, affixed to disc 12 provides means for turning disc 12 which is freely rotatable on rod 11. The disc 12 may be turned so that holes 13 align with holes 14 in door 8*a* as shown in FIG. 7 thereby allowing maximum draft or the disc may partially close off holes 14 or completely close holes 14 as shown in FIG. 6** cutting off the draft entirely.

FIG. 8 is an elevational view in part cross sectional, taken along line 8—8 of FIG. 1, to more clearly illustrate the gasketing means 34 and the door closure means comprising "Z"-shaped metal bar 28 extending through door **8*a* and being secured by engaging wedge 50 which is affixed to center door divider 29. A downward turn on the outside of handle 28** effects locking of the doors and an upward turn unlocks these doors.

FIG. 9 shows spark and heat shield 22 discussed previously.

As thus described herein, the fireplace assembly of this invention provides improved heat output and efficiency over the conventional fireplace. In its most efficient mode with the doors closed, heat is radiated from the firebox and convected from the hollow space beneath the combustion zone into the surrounding air. Water vapor is produced from the trough at the top of the firebox to humidify the air. If desired, the firebox doors may be opened and the unit operated in this fashion to provide the pleasing effects associated with an open fire.

While the invention has been described above in connection with certain specific details and embodiments, it will be clear to one skilled in the art that changes or modifications deviating from these specific embodiments may be made without deviating from the gist of this invention, and such changes and modifications are deemed to fall within the scope of the claims below.

I claim:

1. A fireplace assembly comprising a firebox installed upon the hearth of a fireplace in which to support combustion, said firebox having at least one door through which fuel may be introduced into the combustion zone, each such door having controllable draft means through which the flow of air to support combustion may be controlled, and having a smoke outlet box mounted on the rear of said firebox extending into the fireplace opening, there being an opening in the rear wall of said firebox into said outlet box through which the generated smoke passes into said smoke outlet box and thence through controllable damper means located on said smoke outlet box and opening into the chimney of said fireplace, said damper means controlling the amount of smoke and heat passing up said chimney, and having a spark shield located in said firebox attached to the rear wall thereof and at least partially covering said opening into said smoke outlet chamber, said spark shield extending into said combustion chamber from above said opening into said smoke outlet box in a direction forwardly and downwardly from said opening and substantially covering said opening but providing a gap between said shield and said opening at both substantially vertical sides of said shield and at the lower, substantially horizontal, side of said shield, and having a smoke shelf protruding from the front wall of said firebox substantially horizontally and rearwardly into said combustion chamber and being located at a vertical position between the top and bottom of said spark shield, whereby said spark shield and smoke shelf cooperatively coact to provide enhanced heat circulation and spark control within said firebox.

2. The fireplace assembly of claim 1 wherein said firebox is supported by support means a distance above said hearth to provide a hollow space below the floor of said firebox.

3. The assembly of claim 2 wherein means for supporting the firebox above said hearth conveniently are downward extensions of the front and side walls of said firebox and have at least one vent opening in at least one of said walls into said hollow space.

4. The fireplace assembly of claim 1 having two doors opening into said combustion chamber.

5. The fireplace assembly of claim 1 wherein each said draft means comprises a large disc having a plurality of openings therethrough and being affixed to said door by means of a second, smaller disc and a rod, wherein said rod is affixed to said smaller disc at one end thereof and passes through an opening in the center of said large disc, the diameter of which center opening is slightly larger than the diameter of said rod but smaller than the diameter of said smaller disc, said rod thence passing into a hole through said door and being affixed to said door thereat, said door having a plurality of openings such that said large disc may be rotated so that said holes in said large disc align with said holes in said door, thereby allowing maximum draft, or said disc may be rotated so that said holes in said door are partially or completely closed.

6. The assembly of claim 3 having at least one opening into said hollow space in each said side wall, thereby to enhance convection.

7. The assembly of claim 1, each said door having hinge means connecting said door to said firebox comprising wedge shaped steel hinge brackets mounted at the top and bottom of said door and rectangular steel brackets mounted on the front wall of said firebox so that, when said door is installed, each said wedge shaped bracket is immediately adjacent each said rectangular bracket, and having a removable pin extending through openings in each such bracket from said top bracket downwardly through said bottom bracket.

8. The assembly of claim 1 having door closure means comprising a "Z"-shaped steel bar inserted through each door wherein one leg of said bar is outside said firebox and one leg is inside said firebox which, upon downward rotation of said outer leg, said inner leg engages with a wedge member located on the door support and snugly secures said door in a closed position.

9. The assembly of claim 1 wherein said shield is constructed in three sections, namely an upper section affixed at the top to the back wall of the firebox and slanting forwardly and downwardly from the top of said opening, a middle section affixed to the upper section and extending downwardly substantially parallel to the plane of said opening, and a lower section affixed to said second section and extending from the bottom of the second section downwardly and rearwardly leaving a gap between the lower edge of this lower section and the rear wall of said firebox.

10. The fireplace assembly of claim 1 including a trough located at the top of said firebox, whereby water placed into said trough during combustion humidifies the air around said fireplace assembly.

* * * * *